US010669786B2

(12) United States Patent
Marshall et al.

(10) Patent No.: US 10,669,786 B2
(45) Date of Patent: Jun. 2, 2020

(54) TWO-PART BIT WIRING ASSEMBLY

(71) Applicant: Novatek IP, LLC, Provo, UT (US)

(72) Inventors: Jonathan D. Marshall, Mapleton, UT (US); Geoffrey Charles Downton, Stroud (GB)

(73) Assignee: NOVATEK IP, LLC, Provo, UT (US)

( * ) Notice: Subject to any disclaimer, the term of this patent is extended or adjusted under 35 U.S.C. 154(b) by 0 days.

(21) Appl. No.: 16/216,999

(22) Filed: Dec. 11, 2018

(65) Prior Publication Data

US 2019/0301247 A1 Oct. 3, 2019

Related U.S. Application Data

(63) Continuation of application No. 15/944,605, filed on Apr. 3, 2018.

(51) Int. Cl.
*E21B 17/02* (2006.01)
*E21B 17/042* (2006.01)

(52) U.S. Cl.
CPC ..... *E21B 17/023* (2013.01); *E21B 17/028* (2013.01); *E21B 17/042* (2013.01)

(58) Field of Classification Search
CPC ..... E21B 17/023; E21B 17/028; E21B 17/042
See application file for complete search history.

(56) References Cited

U.S. PATENT DOCUMENTS

| | | | | |
|---|---|---|---|---|
| 6,338,390 | B1 * | 1/2002 | Tibbitts | E21B 7/24 175/381 |
| 8,141,657 | B2 | 3/2012 | Hutton | |
| 8,727,036 | B2 | 5/2014 | Johnson et al. | |
| 8,757,294 | B2 | 6/2014 | Johnson et al. | |
| 8,763,726 | B2 | 7/2014 | Johnson et al. | |
| 9,255,450 | B2 | 2/2016 | Jain et al. | |
| 9,279,293 | B2 | 3/2016 | Izbinski | |
| 9,708,859 | B2 | 7/2017 | Jain et al. | |
| 2012/0085585 | A1 * | 4/2012 | Scott | B22D 19/14 175/428 |
| 2016/0053551 | A1 | 2/2016 | Jain et al. | |
| 2017/0175455 | A1 | 6/2017 | Jain et al. | |
| 2018/0038171 | A1 * | 2/2018 | Hall | E21B 17/028 |

* cited by examiner

*Primary Examiner* — Nicole Coy
*Assistant Examiner* — Yanick A Akaragwe
(74) *Attorney, Agent, or Firm* — Philip W. Townsend, III

(57) ABSTRACT

A downhole drilling assembly may comprise a sub secured between a drill string and a drill bit. The sub may comprise a cavity with a chassis housed therein. The drill bit may also comprise a cavity with an extender housed therein. This extender may provide access for various types of communication to reach into the drill bit's cavity. Several pairs of interfacing exchange surfaces may allow for communication (e.g. passing electrical, hydraulic, optical or electromagnetic signals) between these various elements. One pair of interfacing exchange surfaces, between the drill string and the chassis, may allow for communication regardless of relative rotational orientation. Two other pairs of interfacing exchange surfaces, one between the chassis and the extender and another between the extender and the drill bit, may require a specific rotational orientation for communication.

20 Claims, 5 Drawing Sheets

TWO-PART BIT WIRING ASSEMBLY

CROSS REFERENCE TO RELATED APPLICATIONS

This patent is a continuation-in-part of U.S. patent application Ser. No. 15/944,605 entitled "Downhole Drill Bit Chassis" and filed Apr. 3, 2018 which is incorporated herein by reference for all that it contains.

BACKGROUND

When exploring for or extracting subterranean resources, such as oil, gas, or geothermal energy, and in similar endeavors, it is common to form boreholes in the earth. Such boreholes are often formed by engaging the earth with a rotating drill bit capable of degrading tough earthen materials. As rotation continues the borehole may elongate and the drill bit may be fed into it on the end of a drill string.

At times it may be desirable to take measurements or perform various functions within a borehole while drilling is in progress. It is believed that certain measurements and functions are most effective when taken or performed as close as possible to an end of a drill string, or on a drill bit itself. Drill bits of this type, however, often experience significant wear and damage while drilling, due to the harsh conditions. Worn or damaged drill bits often require replacement which can be expensive and time consuming. Instrumenting drill bits to take measurements or perform functions may significantly add to replacement expense and complexity.

One of the more complex aspects of instrumenting such a drill bit is providing a mechanism for communicating back and forth across the connection between the drill bit and the drill string. Such connections are typically made by threading a drill bit to a drill string amid an often dirty and hectic drilling operation. Given the disorder of such conditions it may be difficult to certify the final positions, either rotationally or axially, of the drill bit relative to the drill string. Any communication mechanism spanning such a connection must be robust and functional regardless of orientation.

Another feature adding complexity to drill bit instrumentation is the externally-threaded protrusions and the internally-threaded cavities that commonly form either side of the connection. In particular, passing communications into a cavity may be difficult as access may be restricted by space constraints. Thus, a mechanism capable of passing communications across a drill-string-to-drill-bit connection independent of specific rotational orientation while providing access inside a threaded cavity may prove useful in instrumenting a drill bit.

BRIEF DESCRIPTION

A downhole drilling assembly may comprise a sub secured between a drill string and a drill bit. This sub may comprise a cavity formed therein and a chassis may be housed within the cavity. The drill bit may also comprise a cavity formed therein and an extender may be housed within this cavity. This extender may contact the drill bit at a base of this cavity and extend to within two inches of a mouth of the cavity. This extender may provide access for various types of communication to reach into the drill bit's cavity.

Several pairs of interfacing exchange surfaces may allow for communication (e.g. passing electrical, hydraulic, optical or electromagnetic signals) between these various elements. One pair of interfacing exchange surfaces, between the drill string and the chassis, may allow for communication regardless of relative rotational orientation. Two other pairs of interfacing exchange surfaces, one between the chassis and the extender and another between the extender and the drill bit, may require a specific rotational orientation for communication.

The first pair of interfacing exchange surfaces may allow for communication regardless of rotational orientation. Meanwhile, the extender may allow for access within the cavity of the drill bit. The combination may allow for measurements to be taken or functions to be performed on the drill bit.

DRAWINGS

FIGS. 3-1 and 3-2 are perspective views of additional embodiments of downhole drilling assemblies.

DETAILED DESCRIPTION

Figure 1:
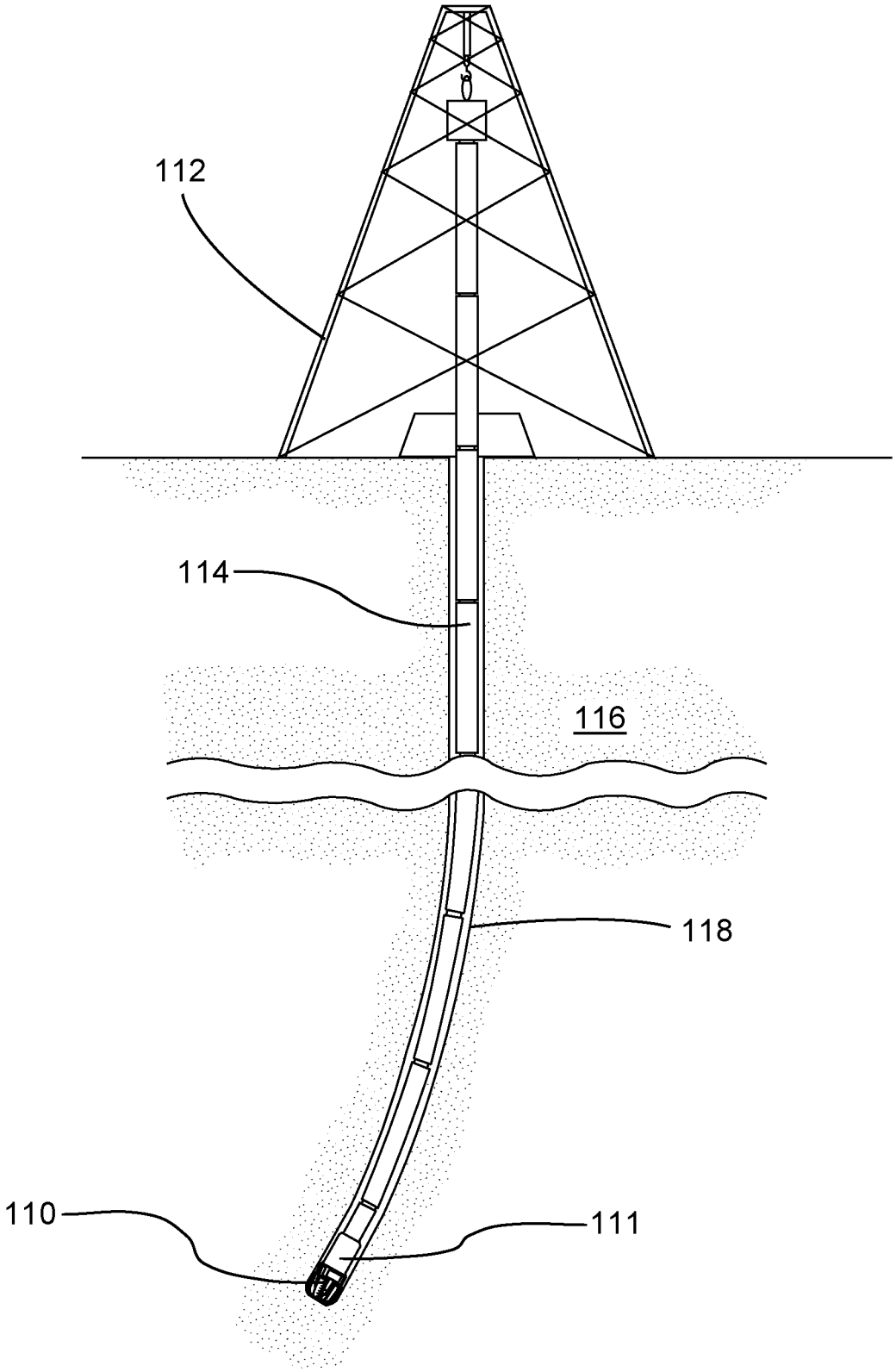
FIG. 1 is an orthogonal view of an embodiment of a subterranean drilling operation.

Referring now to the figures, FIG. 1 shows an embodiment of a subterranean drilling operation of the type commonly used to form boreholes in the earth. Specifically, a drill bit 110, capable of degrading tough subterranean materials, may form part of a downhole drilling assembly 111. The drilling assembly 111 may be attached to one end of a drill string 114 suspended from a derrick 112. While a land-based derrick 112 is depicted, comparable water-based structures are also common. Such a drill string 114 may be formed from a plurality of drill pipe sections fastened together end-to-end, as shown, or, alternately, a flexible tubing. As the drill bit 110 is rotated, either with torque from the derrick 112 passed through the drill string 114 or by a downhole motor, it may engage and degrade a subterranean formation 116 to form a borehole 118 therethrough.

Figure 2:
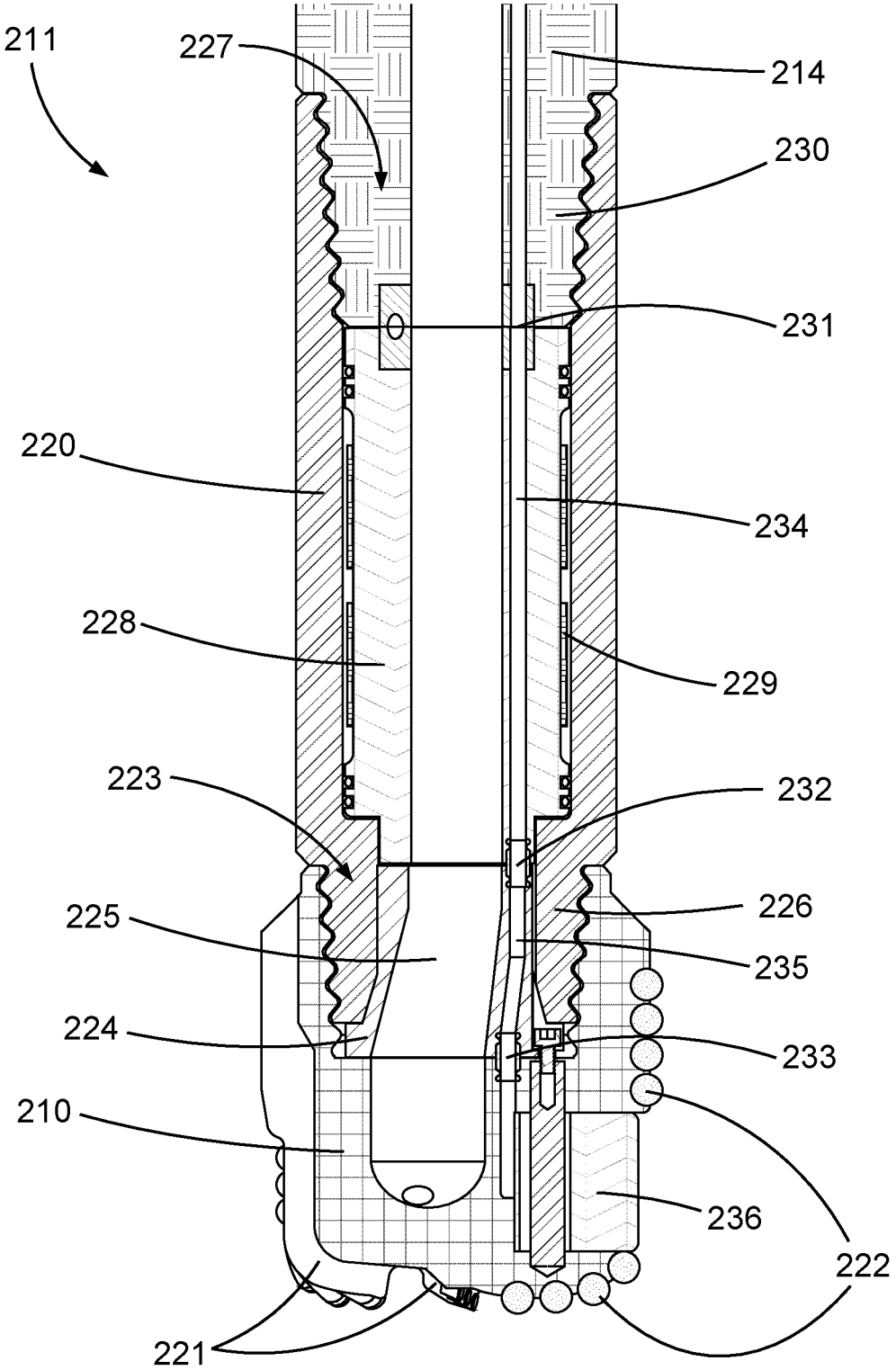
FIG. 2 is a longitude-sectional view of an embodiment of a downhole drilling assembly that may form part of a subterranean drilling operation.

FIG. 2 shows an embodiment of a downhole drilling assembly 211 comprising a drill string 214 secured to a sub 220, and the sub 220 further secured to a drill bit 210. A continuous fluid channel 225 may pass axially through the drill string 214 and sub 220, and into the drill bit 210. While any of a variety of types of drill bits may serve in this role and function with the novel elements described herein, the present embodiment drill bit 210 comprises a plurality of blades 221, spaced around a central axis, protruding from one end thereof. A plurality of cutting elements 222 may be exposed on leading edges of each of the blades 221. Such cutting elements 222 may comprise a superhard material (i.e. a material comprising a Vickers hardness test number exceeding 40 gigapascals) capable of degrading tough subterranean materials. When the drill bit 210 is rotated about this axis, the blades 221 may engage an earthen formation allowing the cutting elements 222 to bore a hole therein.

While it is common for drill bits used in downhole drilling to comprise a threaded protrusion extending therefrom for attachment, the drill bit 210 of the embodiment shown comprises an internally-threaded cavity 223 positioned axially opposite the blades 221 and cutting elements 222. An extender 224 may be seated within this cavity 223. This may allow for access deep into the drill bit 210. When seated, this extender 224 may comprise a proximal end that contacts a nadir of the drill bit 210 cavity 223. The cavity 223 may be formed so deep into the drill bit 210 that the cutting elements 222 axially span this proximal end and nadir. The extender 224 may also comprise and a distal end that extends to within 2 inches of a mouth of the cavity 223. It is believed that this positioning relative to the cavity's 223 mouth may allow for relatively easy access to this distal end. In the embodiment shown, the extender 224 comprises a generally conical exterior shape. This conical shape may be widest toward the proximal end and narrow as it approaches the distal end. Additionally, the fluid channel 225 may pass axially through the extender 224.

The sub 220 may be secured to the drill bit 210 via an externally threaded protrusion 226 that may be inserted into the cavity 223 of the drill bit 210 and mate with the internal threads therein. These threads may be designed to cease rotation and lock into place at a fixed rotational and axial position. Threading of this protrusion 226 into the cavity 223 may act to retain the extender 224 within the cavity 223. Similarly, unthreading of the protrusion 226 and cavity 223 may release the extender 224 such that it may be interchangeable with an alternate extender.

The sub 220 may also comprise a cavity 227 disposed therein comprising internal threads spread over at least a section thereof. A chassis 228, comprising a generally tubular structure, may be housed within this cavity 227. The drill string 214 may comprise an externally threaded protrusion 230 that may be inserted into the cavity 227 of the sub 220 and mate with the internal threads therein. These threads may be designed to cease rotation and lock into place at a fixed rotational and axial position. Threading of this protrusion 230 into the cavity 227 may act to both secure the drill string 224 to the sub 220 and retain the chassis 228 within the cavity 227. While, unthreading the drill string 224 from the sub 220 may allow for both the sub 220 and the chassis 228 to be interchangeable with an alternate sub or chassis (or both) of different axial length. The fluid channel 225 may pass axially through the chassis 228.

Pairs of interfacing exchange surfaces, at each of the intersections between the drill bit 210, the sub 220 and the drill string 214, may allow for various types of communications to occur between these elements. Mating of each of these pairs of interfacing exchange surfaces, in a manner allowing for communication, may naturally result from the physical attachment of the drill string 214 to the sub 220 and the sub 220 to the drill bit 210 without additional action. This may allow for such mating to be accomplished as part of the activities already commonly performed as part of a drilling operation.

A first pair of interfacing exchange surfaces 231 may connect the drill string 214 to the chassis 228 within the sub 220; specifically, one of the first pair of interfacing exchange surfaces 231 may be disposed on a tip of the protrusion 230 formed on one end of the drill string 214. This first pair of interfacing exchange surfaces 231 may allow for communication between the drill string 214 and the chassis 228 regardless of where they land in rotational orientation relative to each other. This independence from reliance on relative rotational orientation for communication may provide an allowance for play in the physical attachment of the drill string 214 to the sub 220; which often occurs under dirty and hurried conditions at a drilling location.

A second pair of interfacing exchange surfaces 232 may connect the chassis 228 to the extender 224 within the drill bit 210. And a third pair of interfacing exchange surfaces 233 may connect the extender 224 to the drill bit 210, in which it is housed. These third interfacing exchange surfaces 233 may be positioned inside of internal threads within the cavity 223 of the drill bit 210. The extender 224 may be long enough axially that the cutting elements 222, exposed on an exterior of the drill bit 210, axially span this connection between the extender 224 and the drill bit 210. As opposed to the first pair, the second and third pairs of interfacing exchange surfaces 232, 233 may be fixed together in specific relative rotational orientations. In some embodiments, rotational orientation may be maintained by forming stab style connections. Further unlike the first pair, these orientation-specific interfacing exchange surfaces 232, 233 may be connected under cleaner and calmer conditions, removed from the drilling location, that may generally lead to more accurate positioning. Additionally, the extender 224 may aid in bringing such connections out of the cavity 223 of the drill bit 210 that could restrict access. Speaking of the extender 224, one side of each of the second and third pairs of interfacing exchange surfaces 232, 233 may be connected to one another via at least one communication conduit 235 passing through the extender 224.

One side of each of the first and second pairs of interfacing exchange surfaces 231, 232 may be connected to one another via at least one communication conduit 234 passing through the chassis 228. The chassis 228 may further comprise various electronics 229 disposed circumferentially about an exterior surface thereof. These electronics 229 may be housed within a pressure chamber formed between the chassis 228 and the sub 220. These electronics 229 may also be connected to at least one side of the first and second pairs of interfacing exchange surfaces 231, 232 via the communication conduit 234 described previously. As the sub 220 may be longer than the drill bit 210, as shown in this embodiment, the size of these electronics 229 need not be limited by the length of the drill bit 210.

A pad 236 may be radially extendable or retractable from a side of the drill bit 210 via hydraulic pressure applied through the various communication conduits 234, 235 described previously. Extension of this pad 236 may be to perform any of a variety of downhole functions, such as steering or stabilization. Specifically, as the pad 236 extends it may push against an interior of a borehole (not shown) through which the drill bit 210 is traveling to change its direction of travel or hold it in place. Activation of such a downhole function may be controlled by the electronics 229 disposed downhole around the chassis 228.

Figures 1, 3:
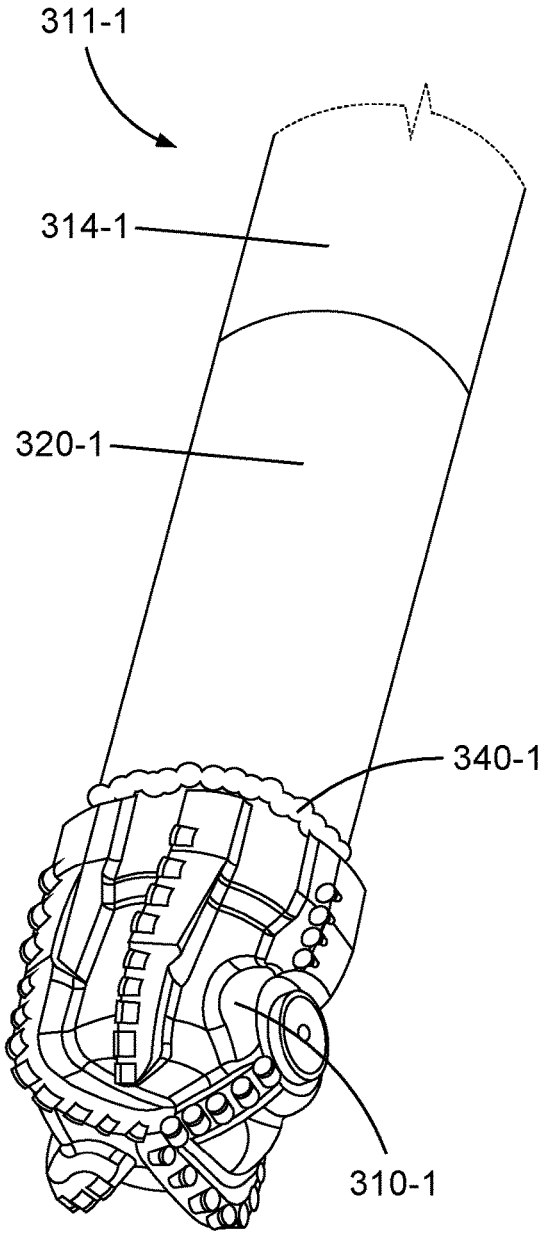
Figures 2, 3:
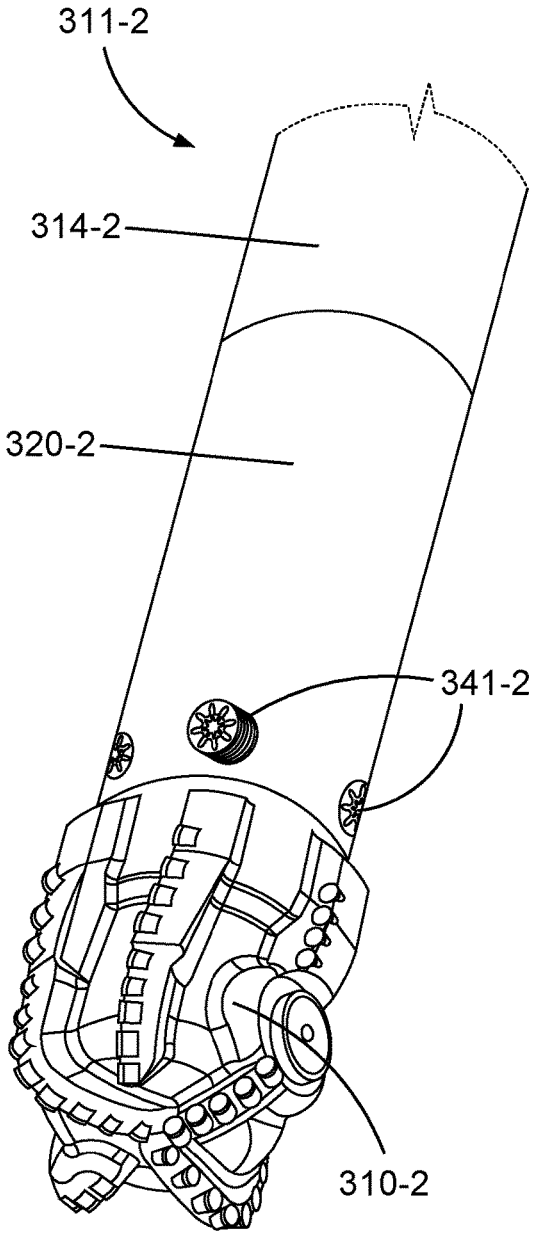

FIGS. 3-1 and 3-2 show additional embodiments of downhole drilling assemblies 311-1 and 311-2 respectively. Each of the downhole drilling assemblies 311-1, 311-2 may comprise a drill string 314-1, 314-2 secured to a sub 320-1, 320-2, which is further secured to a drill bit 310-1, 310-2. Further, each embodiment comprises a mechanism, in addition to threads (hidden) described previously, for securing the attachment of the sub 320-1, 320-2 to its respective drill bit 310-1, 310-2. This additional security may be to prevent accidental or unintentional removal of the drill bit 310-1, 310-2 from the sub 320-1, 320-2 while attempting to remove the sub 320-1, 320-2 from its respective drill string 314-1, 314-2.

Specifically, FIG. 3-1 shows an embodiment of a downhole drilling assembly 311-1 comprising a weld or adhesive 340-1 securing the drill bit 310-1 to the sub 320-1. FIG. 3-2 shows an embodiment of a downhole drilling assembly 311-2 comprising a plurality of mechanical fasteners 341-2 that may each be threaded radially into the sub 320-2 to further secure the drill bit 310-2 to the sub 320-2. One of these mechanical fasteners 341-2 is shown partly removed to reveal the threads. Additionally, each of these mechanical fasteners 341-2 may comprise an exposed head comprising a unique geometry requiring a specialized tool for removal.

Figure 4:
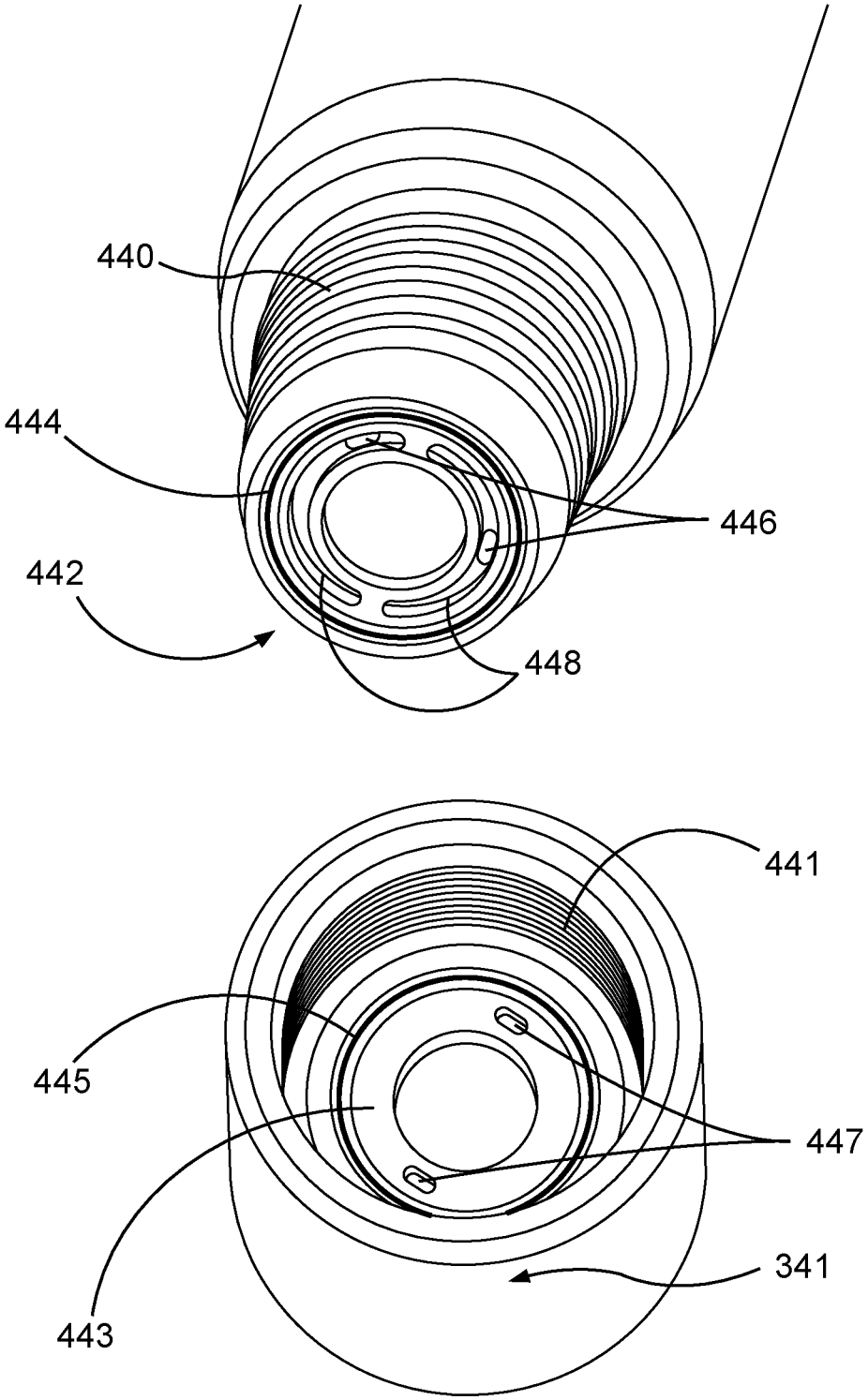
FIG. 4 is a perspective view of an embodiment of a rotationally-independent pair of interfacing exchange surfaces.

Each of the first, second and third pairs of interfacing exchange surfaces may allow for various types of communication. For example, any of the pairs of interfacing exchange surfaces may allow for the exchanging of electrical, hydraulic, optical and/or electromagnetic signals; although, they may do this in different ways. Specifically, the first pair of interfacing exchange surfaces, between the drill string and the chassis, may allow for this communication independent of any specific rotational orientation. FIG. 4 shows one possible embodiment of a rotationally-independent pair of interfacing exchange surfaces. Particularly, a threaded protrusion 440 may be received and secured within a threaded cavity 441. This protrusion 440 comprises one interfacing exchange surface 442 disposed on a distal tip thereof. In the embodiment shown, this interfacing exchange surface 442 is capable of exchanging power and data, via electricity and hydraulic fluid, with another interfacing exchange surface 443 housed within the cavity 441. While this embodiment shows electrical and hydraulic based communication, other media such as optical or electromagnetic signals are also possible.

With respect to electricity, the interfacing exchange surface 442 comprises an inductive ring 444 that may sit adjacent another inductive ring 445 of the other interfacing exchange surface 443. While adjacent, electrical signals passing through the one inductive ring 444 may be communicated to the other inductive ring 445 via inductive coupling. These electrical signals may be passed regardless of relative rotational orientation of the pair of interfacing exchange surfaces 442, 443.

With respect to hydraulic fluid, the interfacing exchange surface 442 comprises two ducts 446 exposed thereon that may conduct fluid to two other ducts 447 exposed on the other interfacing exchange surface 443. These sets of two ducts 446, 447 may allow for hydraulic power and/or pulsing data to be transmitted between the pair of interfacing exchange surfaces 442, 443. Two nearly-semiannular grooves 448 may also be positioned on the interfacing exchange surface 448 inside the inductive ring 444 discussed previously, one adjacent each of the two ducts 446 exposed thereon. These nearly-semiannular grooves 448 may allow fluid to flow therethrough from the two ducts 446 of the protrusion 440 to the two ducts 447 of the cavity 441 in a wide span of relative rotational orientations. As can be seen, only one of a pair of interfacing exchange surfaces needs such grooves for this type of rotationally independent fluid transfer.

In the embodiment shown, the ducts 447 are positioned directly opposite each other, or 180 degrees apart, however, this spacing is not necessary. Specifically, similar ducts may be spaced at different angular positions in different embodiments. Further, threads of the protrusion 440 may be roughly timed to threads of the cavity 441 such that, even under imprecise conditions, the ducts 447 are not blinded by blanks between the nearly-semiannular grooves 448.

Figure 5:
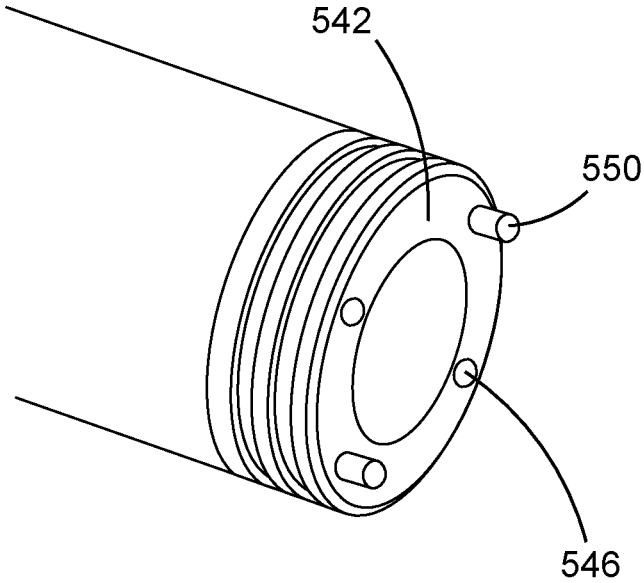
FIG. 5 is a perspective view of an embodiment of a rotationally-specific pair of interfacing exchange surfaces.
Figure 5:
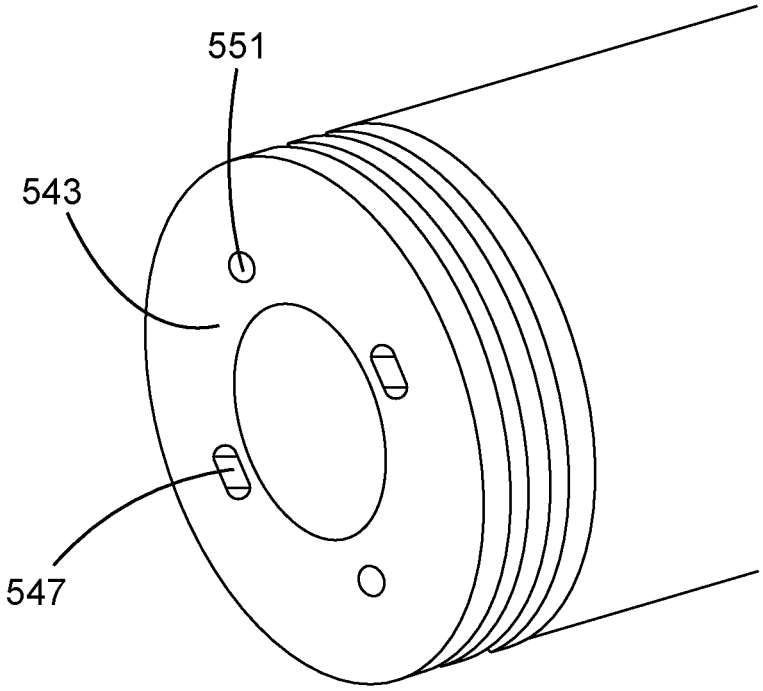

Other pairs of interfacing exchange surfaces, such as the second pair between the chassis and the extender and the third pair between the extender and the drill bit, may require a specific rotational orientation for communication. FIG. 5 shows one possible embodiment of a rotationally-fixed pair of interfacing exchange surfaces. One interfacing exchange surface 542 may comprise a plurality of pins 550 protruding therefrom. Another interfacing exchange surface 543 may comprise a plurality of sockets 551 into which the pins 550 may insert when the two interfacing exchange surfaces 542, 543 are paired with one another. Insertion of the pins 550 into the sockets 551 may align a plurality of ducts 546 exposed on the one interfacing exchange surface 542 with a matching plurality of ducts 547 exposed on the other interfacing exchange surface 543. In such a configuration, fluid may flow between the two sets of ducts 546, 547 to transmit hydraulic power and/or pulsing data between the interfacing exchange surfaces 542, 543 when rotationally aligned in a specific orientation. Further, the pins 550 and sockets 551 may be wired to transmit electrical power and/or data.

Whereas the present discussion has referenced the figures attached hereto it should be understood that other and further modifications, apart from those shown or suggested herein, may be made within the scope and spirit of the present disclosure.

The invention claimed is:

1. A downhole drilling assembly, comprising:
a drill string secured to a sub;
a chassis housed within a cavity of the sub;
the sub secured to a drill bit;
an extender housed within a cavity of the drill bit;
a first pair of interfacing exchange surfaces, between the chassis and the drill string, are fixed together independent of rotational orientation;
a second pair of interfacing exchange surfaces, between the chassis and the extender, are fixed together in a specific rotational orientation; and
a third pair of interfacing exchange surfaces, between the extender and the drill bit, are fixed together in a specific rotational orientation.

2. The downhole drilling assembly of claim 1, wherein the first, second and third pairs of interfacing exchange surfaces are each capable of exchanging at least one of electrical, hydraulic, optical and electromagnetic signals.

3. The downhole drilling assembly of claim 1, wherein:
the drill string comprises a first protrusion inserted into the cavity of the sub;
one of the first pair of interfacing exchange surfaces is disposed on an end of the first protrusion;
the sub comprises a second protrusion inserted into the cavity of the drill bit; and
none of the interfacing exchange surfaces are disposed on the second protrusion.

4. The downhole drilling assembly of claim 1, wherein the drill string retains the chassis within the cavity of the sub and the sub retains the extender within the cavity of the drill bit.

5. The downhole drilling assembly of claim 1, wherein the drill string is secured to the sub via threads that cease rotation at a fixed position and the sub is secured to the drill bit via threads that cease rotation at a fixed position.

6. The downhole drilling assembly of claim 5, wherein the sub is additionally secured to the drill bit via a weld or adhesive.

7. The downhole drilling assembly of claim 5, wherein the sub is additionally secured to the drill bit via a mechanical fastener requiring a specialized tool for removal.

8. The downhole drilling assembly of claim 1, wherein the sub and chassis are interchangeable with an alternate sub and chassis of different axial length.

9. The downhole drilling assembly of claim 1, wherein the extender is interchangeable with an alternate extender.

10. The downhole drilling assembly of claim 1, wherein the extender comprises a proximal end contacting a nadir of the drill bit cavity and a distal end positioned within 2 inches of a mouth of the drill bit cavity.

11. The downhole drilling assembly of claim 1, wherein the extender comprises a generally conical exterior shape.

12. The downhole drilling assembly of claim 1, wherein an exterior shape of the extender narrows as it nears a mouth of the drill bit cavity.

13. The downhole drilling assembly of claim 1, wherein one of each of the first and second pairs of interfacing exchange surfaces are connected via conduits passing through the chassis.

14. The downhole drilling assembly of claim 1, wherein one of each of the second and third pairs of interfacing exchange surfaces are connected via conduits passing through the extender.

15. The downhole drilling assembly of claim 1, further comprising a fluid channel passing through the drill string, chassis, and extender.

16. The downhole drilling assembly of claim 1, wherein the sub is axially longer than the drill bit.

17. The downhole drilling assembly of claim 1, wherein the chassis comprises electronics disposed circumferentially about an exterior surface thereof, within a pressure chamber between the chassis and the sub, and connected to at least one of the first and second pairs of interfacing exchange surfaces.

18. The downhole drilling assembly of claim 1, wherein both the second and third pairs of interfacing exchange surfaces comprise stab connectors.

19. The downhole drilling assembly of claim 1, wherein the drill bit comprises cutting elements exposed thereon axially spanning the third pair of interfacing exchange surfaces.

20. The downhole drilling assembly of claim 1, wherein the cavity of the drill bit comprises threads therein and the third pair of interfacing exchange surfaces is positioned inside the threads.

* * * * *